United States Patent [19]

Hubbard

[11] 4,246,643

[45] Jan. 20, 1981

[54] LOW COST POSTAGE APPLICATOR

[75] Inventor: David W. Hubbard, Stamford, Conn.

[73] Assignee: Pitney Bowes Inc., Stamford, Conn.

[21] Appl. No.: 877,175

[22] Filed: Feb. 13, 1978

[51] Int. Cl.[2] ..... B41L 47/46

[52] U.S. Cl. ..... 364/900; 101/91

[58] Field of Search ..... 364/900 MS File, 466, 364/567; 101/45, 91; 400/131, 180; 235/58 PS, 58 P, 61 PS, 92 WT, 432

[56] References Cited

U.S. PATENT DOCUMENTS

| | | | |
|---|---|---|---|
| 2,001,287 | 5/1935 | Ryan | 101/91 |
| 3,508,488 | 4/1970 | Maul et al. | 101/45 |
| 3,938,095 | 2/1976 | Check, Jr. et al. | 364/900 |
| 4,090,063 | 5/1978 | Martin | 101/91 X |
| 4,140,054 | 2/1979 | Martin et al. | 101/91 |
| 4,140,055 | 2/1979 | Lallemand | 101/91 |

FOREIGN PATENT DOCUMENTS 973200 10/1963 United Kingdom .

*Primary Examiner*—Raulfe B. Zache

*Attorney, Agent, or Firm*—David E. Pitchenik; William D. Soltow, Jr.; Albert W. Scribner

[57] ABSTRACT

A low cost postage applicator includes postage printing wheels which can be manually set by thumbwheels accessible through an access opening in a housing. Encoders provide electrical signals representative of the position of each printing wheel. The housing is depressed toward a letter or package to be imprinted. During an initial part of the depression stroke, an inking roller is drawn across the printing wheel face, the access opening is misaligned with the thumbwheels to prevent further setting changes and a contact switch is closed to enable a microcomputer to read and compare the printing wheel settings with the contents of an electronic descending register. If adequate postage is available and if a letter sensing switch indicates that a letter or package is in place, the microcomputer releases a mechanical interlock to allow the housing to be depressed into a printing position in which the printing wheels contact the letter or package. A switch is tripped in the printing position to cause the postage applicator registers to be updated by the amount of postage printed.

30 Claims, 17 Drawing Figures

| | TRACK | | | | |
|---|---|---|---|---|---|
| | T5 | T4 | T3 | T2 | T1 |
| 0 | 0 | 0 | 0 | 1 | 1 |
| 1 | 0 | 0 | 1 | 0 | 1 |
| 2 | 0 | 1 | 0 | 0 | 1 |
| 3 | 1 | 0 | 0 | 0 | 1 |
| 4 | 0 | 0 | 1 | 1 | 0 |
| 5 | 0 | 1 | 0 | 1 | 0 |
| 6 | 1 | 0 | 0 | 1 | 0 |
| 7 | 0 | 1 | 1 | 0 | 0 |
| 8 | 1 | 0 | 1 | 0 | 0 |
| 9 | 1 | 1 | 0 | 0 | 0 |

DECIMAL EQUIVALENTS

POSITION ENCODERS
$10 BANK ENCODER
$1 BANK ENCODER
10¢ BANK ENCODER
1¢ BANK ENCODER
202
204
206
208
MULTIPLEXING CIRCUIT
210
MICRO COMPUTER SET
212
SOLENOID DRIVER CIRCUIT
216
DISPLAY DRIVER CIRCUIT
218
DISPLAYS
220
DISPLAY BUFFERS
222
INKING COMPLETE SWITCH
98
LETTER IN PLACE SWITCH
114
POSTAGE COUNT SWITCH
90
ENERGIZE DISPLAY SWITCH
214

LOW COST POSTAGE APPLICATOR

BACKGROUND OF THE INVENTION

The present invention relates to postage meters and more particularly to a low cost postage applicator.

Postal meters are widely used by large and small businesses. The meters in use today are, almost universally, mechanical devices in which postage values are set, printed, and accounted for by means of mechanical assemblies such as linkages and registers. Such meters include a mechanical ascending register which provides a record of the amount of postage printed over the life of the meter and a mechanical descending register which provides a record of the amount of postage remaining for use in the meter. To prevent tampering with the critical functions of such mechanical meters, a number of different mechanical interlocks have been used. Such interlocks prevent a user from printing postage amounts without changing the contents of the ascending and descending registers. Other interlocks and seals make it nearly impossible for a user, without leaving telltale signs, to reset the descending register himself to "recharge" the postal meter.

Electronic postal meters have been developed. In such meters, a computer device such as a microprocessor may process weight signals, calculate postage amounts and cause an electronically driven printer to be set to the proper postage amount. All data, including critical accounting data, is stored in electrical format in memory units.

The advantages of electronic postage meters are known. Such meters, having fewer mechanical parts, should last longer and prove more reliable than completely mechanical meters. Furthermore, electronic postal meters are extremely versatile devices which may perform functions that cannot practically be performed in a purely mechanical meter. For example, an electronic postal meter may include logic circuitry for determining the destination zone of a package, given the zip code of the point of origin and the zip code of the point of destination. Moreover, such meters can generally be more readily changed to accommodate changes in the postal regulations or rates. Also, such meters are generally capable of performing at high speeds, a necessity for high volume mailing operations.

While the versatility and relative reliability of electronic postal meters make them very attractive for high volume mailing operations, the cost and complexity of known electronic postage meters has limited their usefulness to such mailing operations only.

The field of low cost postage applicators has been largely limited to purely mechanical devices including mechanical ascending and descending registers. Like all mechanical postage meters, the known low cost mechanical postage applicators are potentially subject to wear and reliability problems due to the many moving parts and linkages. Moreover, the manufacturing costs for such low cost mechanical postage applicators can be reduced only to a limited extent due to the fabrication and assembly costs for the mechanical components.

SUMMARY OF THE INVENTION

The present invention is a low cost postage applicator which makes optimum use of mechanical and electronic technology in order to provide a reliable and inexpensive postage applicator having appropriate security features to prevent misuse of the device.

A postage applicator constructed in accordance with the present invention includes a first member which must be depressed by a user to initiate a postage-printing cycle and a plurality of postage printing elements, each of which is independently settable by manually-actuated means. Encoding means provide electrical signals representing the current condition of each of the printing elements. A switch means responds to movement of the first member to a predetermined first position to generate a read-enabling signal while a detent means inhibits movement of the first member beyond the predetermined first position unless certain conditions are met. The applicator further includes an electronic means connected to the encoding means, to the switch means and to the detent means for releasing the detent means under given conditions to permit the first member to be moved past the predetermined first position into a second postage-printing position. The electronic means includes electronic storage locations for postal accounting data.

DESCRIPTION OF THE DRAWINGS

While the specification concludes with claims particularly pointing out and distinctly claiming that which is regarded as the present invention, further details of preferred embodiments of the invention may be more readily ascertained from the following detailed description when read in conjunction with the accompanying drawings wherein:

DETAILED DESCRIPTION

Figure 1:
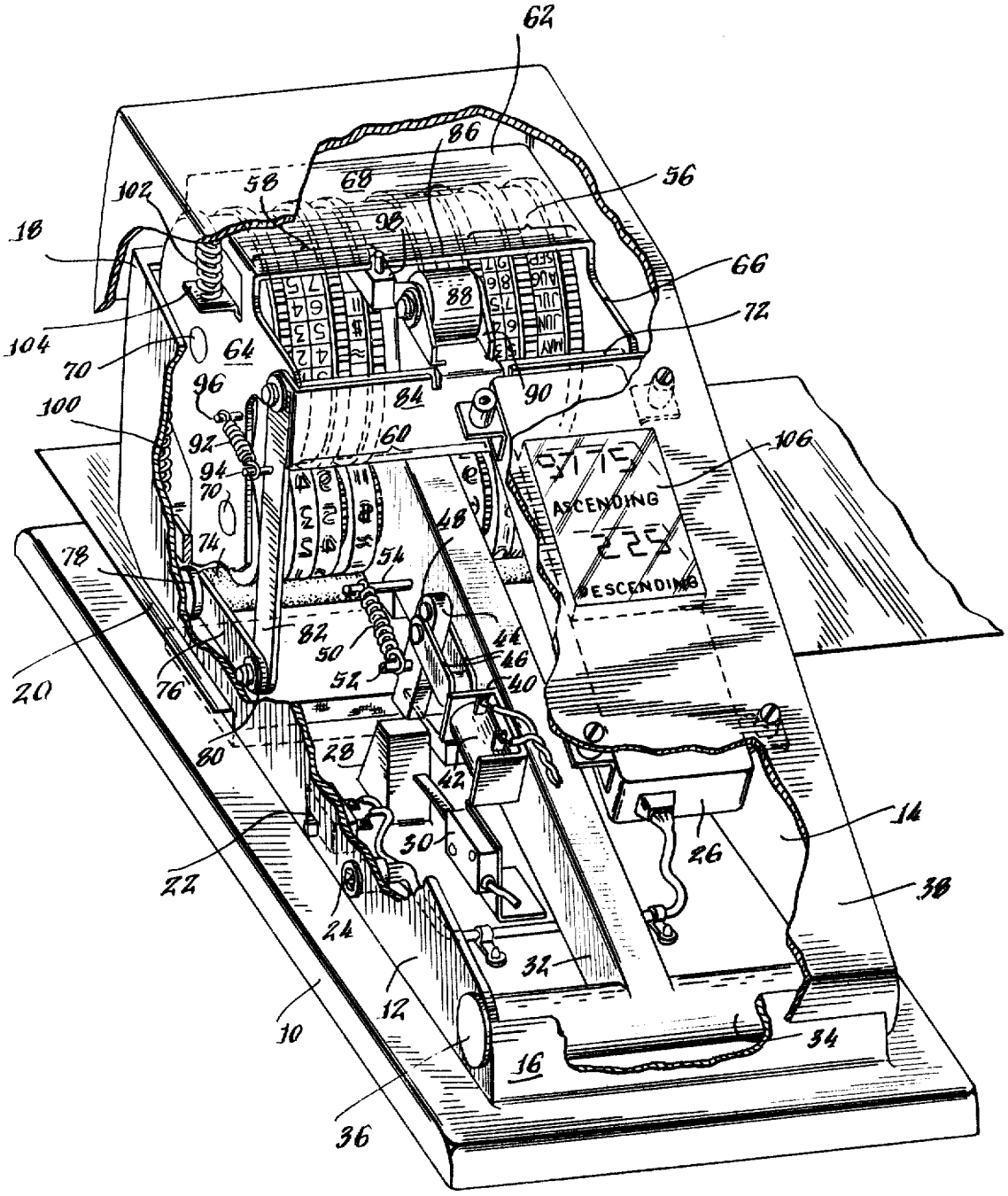
FIG. 1 is a perspective view of one embodiment of the postage applicator with portions of the housing and side walls cut away for purposes of illustrating the invention.

Referring to FIG. 1, a preferred embodiment of postage applicator includes a base plate 10 which supports a pair of spaced, generally-triangular side walls 12 and 14 and a relatively short rear wall 16 connecting the tapered ends of the side walls 12 and 14. The side walls 12 and 14 are connected at their opposite or wider ends by a generally-rectangular, vertical front wall 18. The side walls 12 and 14 are connected to the base plate 10 over approximately the rear half of the base plate with the lower edge of each side wall being spaced slightly above the front half of the base plate to form a letter-receiving slot 20. An on-off switch 22 and a set of meter recharging contacts 24 are secured to the side wall 12 so as to be accessible from outside the applicator. Electrical leads from both the on-off switch 22 and the meter recharging contacts 24 are connected to a microcomputer module 26 contained within the postage applicator.

A detent block 28 and a postage-count switch 30, which has a reed actuator blade, are mounted on the floor of the base plate 10 within the postage applicator. The postage-count switch 30 also is connected electrically to the microcomputer module 26.

Postage-printing elements, which in a preferred embodiment are rotatable printing wheels with raised, peripheral type heads, are carried by a print system frame including a print system support member 32 which can be moved through a limited arc about a pivot point defined by an integral cross piece 34 having sockets at each end for receiving the shanks of pivot pins 36, only one of which is shown. The shanks of the pins 36 extend through aligned openings in the side walls 12 and 14 and similar openings in an overlying cover member 38. The functions of the cover member 38 will be described in more detail later.

A generally U-shaped bracket 40, secured to one wall of the print system support member 32, carries a solenoid 42 having its armature linked to a print system release lever 44 through parallel links 46. The release lever 44 moves about a pivot pin 48 extending from the side wall of the print system support member 32. Release lever 44 is biased in a clockwise movement about pin 48 by a return spring 50 extending between a pin 52 on lever 44 and another pin 54 projecting from the print system support member 32.

As will be described in more detail later, the print system support member 32 widens beyond pin 54 to provide support for shafts upon which a set 56 of date setting thumbwheels, a set 58 of postage setting thumbwheels and a set 60 of postage printing wheels are mounted. A shield 62 having depending side walls 64 and 66 and a connecting bridge member 68 is supported on the shafts by means of bolts 70 which are threaded into sockets at the ends of the wheel-supporting shafts. While only one set of bolts 70 is shown at side wall 64, another identical set exists at side wall 66.

The side walls 64 and 66 of the shield 62 support an inking roller mechanism which pivots about a shaft 72 extending between the side walls. An inking roller 74 located just above the base plate 10 of the postage applicator is connected to the shaft 72 through a rotary-to-linear mechanical linkage including a first arm 76 extending from a support roller 78 at each end of the inking roller 74 to an intermediate pivot point 80. The mechanism includes a second arm 82 extending from the intermediate pivot point 80 to the shaft 72 at the side walls 64 and 66. The same elements exist at the opposite end of the inking roller. The upper ends of the vertical arms 82 are connected by a web 84. An actuating member 86 including a roller 88 journaled in a pillow block 90 extends from the midpoint of the web 84. The roller 88 is forced downward when the cover member 38 is depressed, causing web 84 to pivot about the shaft 72 in a counterclockwise direction. The arm 82 moves to the right, drawing the arm 76 and the inking roller 74 across the face of the printing wheels. A return spring 92 connected between a first pin 94 on arm 82 and a second pin 96 on side wall 64 provides a clockwise return force which returns the ink roller 74 to its rest position.

An inking-complete switch 98, which is secured to the bridge member 68, provides an electrical signal indicating that the cover member 38 has been depressed into contact with the bridge member 68 of the shield 62. A coil spring 100 extends between a support (not shown) on side wall 12 and a restraining member (not shown) on side wall 64 to provide spring forces which tend to bias the shield 62 (and thus the print system support member 32) upward. Another coil spring 102 is compressed between the underside of cover member 38 and a support 104 struck from the side wall 64. The coil spring 102 tends to bias the cover member 38 upward relative to the print system support member 32. Similarly, the coil spring 100 tends to bias the print system upward relative to the base plate 10.

The microcomputer module 26 is supported on the underside of the cover member 38 by means of threaded fasteners making it physically inaccessible unless the cover member 38 is removed and electrically inaccessible except through the meter recharging contacts 24 and the on-off switch 22. As will be discussed later, seals are provided which prevent unauthorized persons from accessing the microcomputer module without leaving evidence they have done so.

Figure 2:
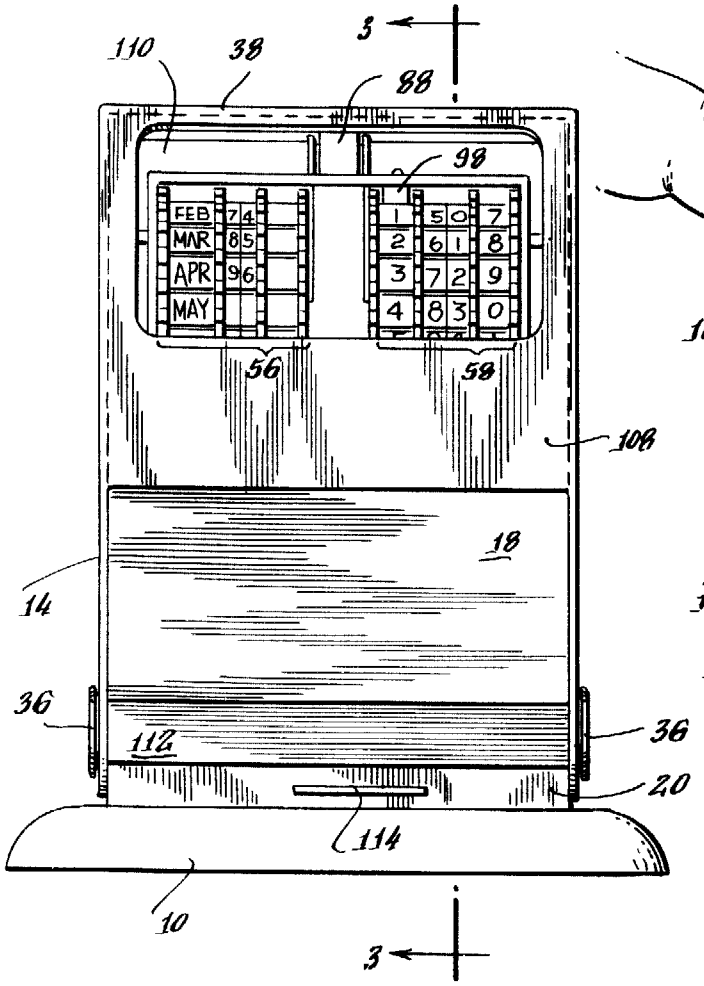
FIG. 2 is a front view of the meter shown in FIG. 1, showing the thumbwheels used to set postage printing wheels employed in a preferred embodiment of the postage applicator.

FIG. 2 is a front view of the exterior of the postage applicator. The cover member 38 includes a front piece 108 with an access opening 110 through which a user can manually set the date thumbwheels 56 and the postage thumbwheels 58. The front wall 18 of the base plate includes a beveled area 112 which makes it easier for a user to insert a letter in the letter-receiving slot 20. The blade of a letter-in-place switch 114 mounted on the base plate 10 can be seen in the letter-receiving slot 20. The exact function of the letter-in-place switch 114 is described in more detail later.

Figure 3:
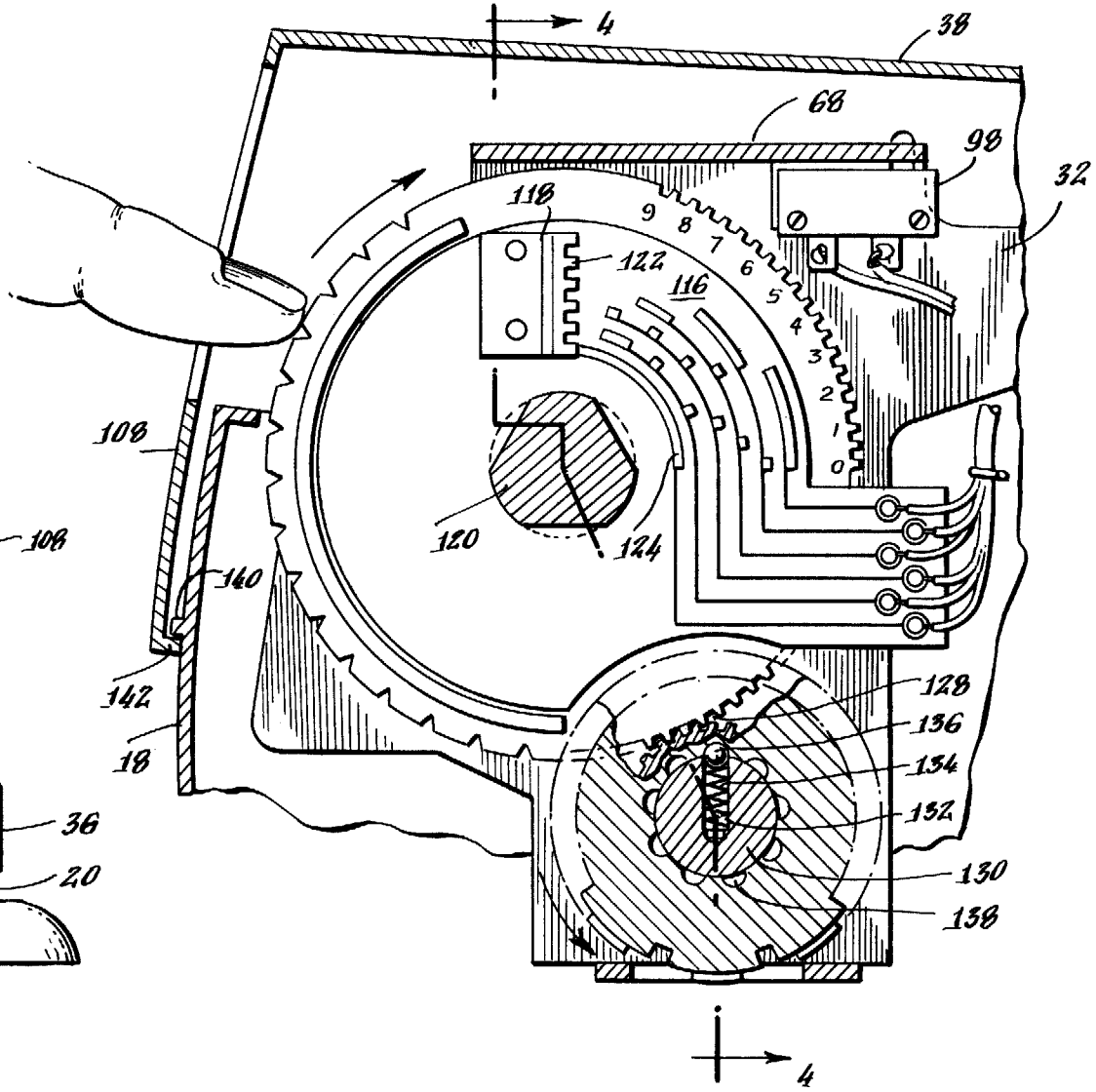
FIG. 3 is a side view, taken along lines 3—3 of FIG. 2, of postage setting and position encoding components for one bank of a preferred embodiment of postage applicator.

Referring to FIG. 3, the position of each of the postage setting thumbwheels in the set 58 is translated into representative electrical signals by an encoding means including an encoding disc 116 and a conductive wiper element 118. Each encoding disc is mounted on a generally triangular shaft 120 which holds the encoding disc in a stationary position relative to the rotatable thumbwheels on which the numerical indicia are printed and to which the wiper element 118 is attached. The encoding disc includes a number of radially-spaced tracks of indicia arranged in position-indicating patterns. In one embodiment, each of the indicia is a conductive contact which may be contacted by a finger 122 of the movable wiper element 118. One of the fingers of the wiper element 118 remains in continuous contact with a track 124 which is connected to a source of reference voltage. Whenever the wiper element 118 is aligned with a track containing a conductive contact, the radial track having that contact is maintained at the reference potential by means of the direct electrical connection through the wiper element 118. All the elements in a single track are connected through a common electrical connection to one of a number of output terminals 126. The combination of potentials on the various tracks, when decoded, provide an indication of the position of the thumbwheel and of the printing wheel to which the thumbwheel is coupled at a gear interface 128.

Each of the postage printing wheels includes a detent mechanism which permits the printing wheel and the meshed thumbwheel to be rotated in stepped movements. The shaft 130 for the postage printing wheels includes a number of spaced bores 132, each of which includes a coil spring 134 biasing a ball 136 radially outward. The ball 136 is received in semi-circular recesses, such as recess 138, formed in the inner hub of each postage printing wheel. As a thumbwheel is turned to misalign one of the recesses, the ball 136 is forced back into the bore 132 until the next recess comes into alignment with the bore. The spring 134 forces the ball into the newly-aligned recess to provide a restraining force which must be overcome before the thumbwheel can be rotated to the next digit position.

While only one encoding disc, wiper element and detent arrangement have been shown, it should be understood that a similar arrangement exists for each bank of the postage meter. That is, for a meter capable of printing four digits of postage (up to $99.99) there would be four position encoding systems of the type illustrated in the drawing.

The front wall 18 of the meter includes a small tab 140 extending outwardly. The front piece 108 of the cover member 38 includes an inwardly extending lip 142. The tab 140 acts as a stop which limits the upward travel of the cover member 38.

Figure 4:
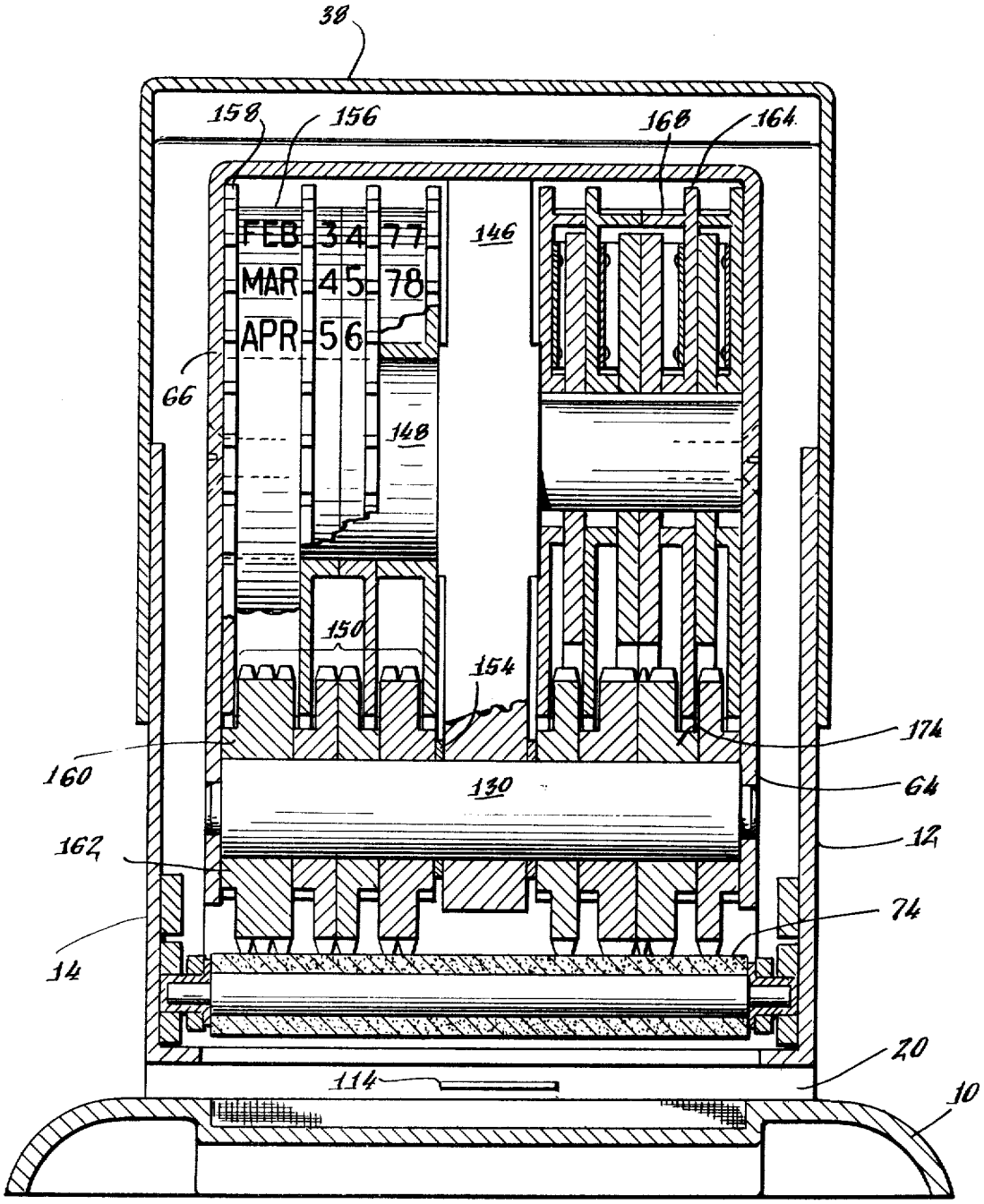
FIG. 4 is a cross-sectional front view, taken along lines 4—4 of FIG. 3, of the set of postage setting and position encoding components of the postage applicator described in FIGS. 1-3.
Figure 5:
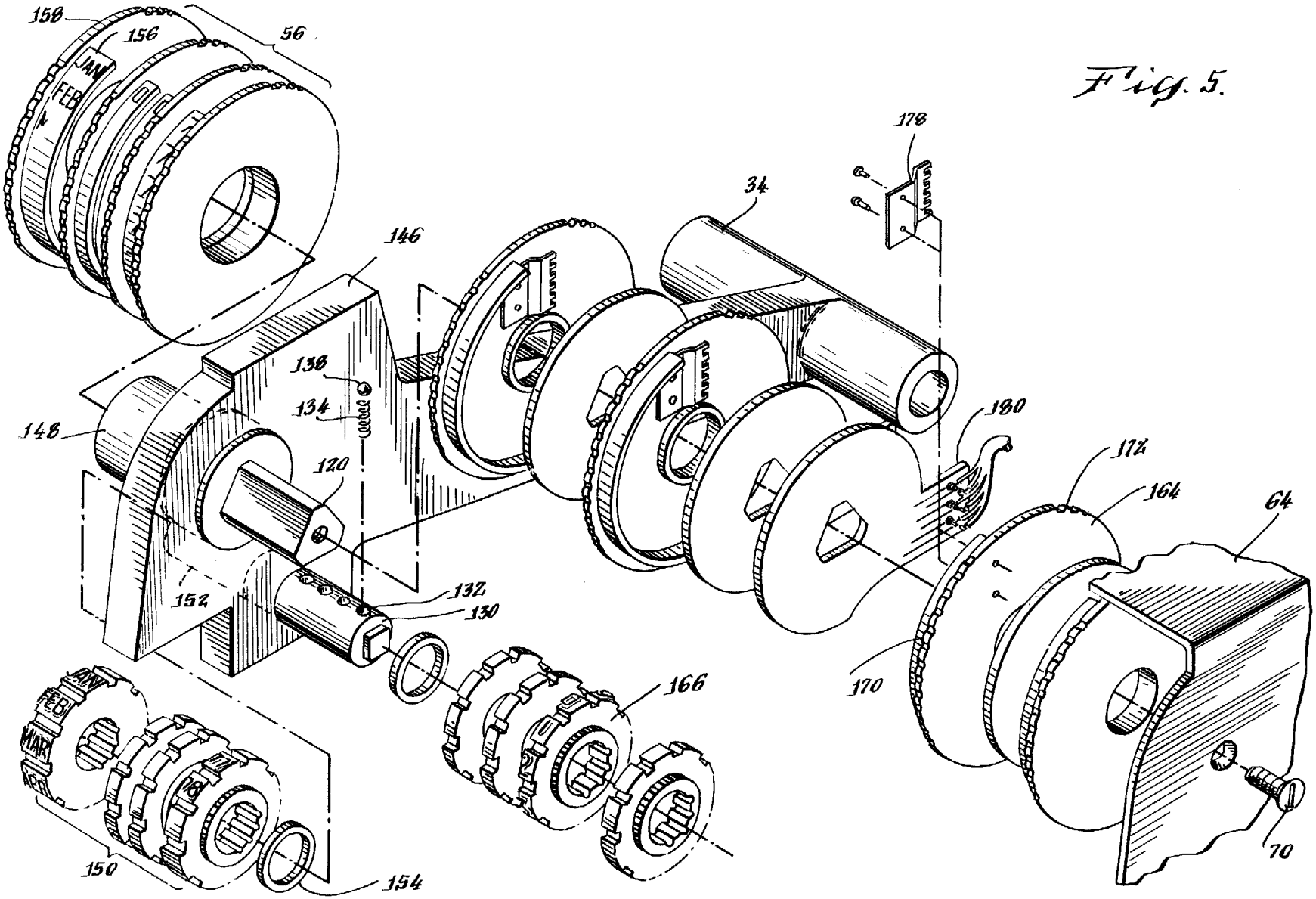
FIG. 5 is an exploded, perspective view of the postage setting and position encoding components of applicator shown in FIGS. 1-4.

Mechanical details and the relative positions of the thumbwheels, the encoding elements and the printing wheels are shown in FIGS. 4 and 5. The print system support member 32 includes a flat web 146 to which the thumbwheel shafts and the printing wheel shafts are attached. The set 56 of date-setting thumbwheels is mounted for rotational movement on a circular shaft 148 extending from the left side of the web 146. Gear teeth formed on a sector of the periphery of each of the date-setting thumbwheels mesh with gear teeth on a shoulder of a wheel in a set 150 of date printing wheels mounted for rotation on shaft 130. Shaft 130 extends both to the left and to the right of the web 146. Referring specifically to FIG. 4, each of the date-setting thumbwheels includes an indicia bearing rim, such as the mouth-indicating rim 156, and a slightly larger serrated or notched flange, such as the flange 158 for the month-indicating wheel. Gear teeth formed on a sector of the flange 158 engage similar gear teeth formed on a shoulder 160 of the mouth printing wheel 162.

The construction of the remaining wheels in the date wheel set is similar with each thumbwheel having a notched peripheral flange with a toothed sector intermeshing with a toothed shoulder on a printing wheel in the set 150. The date printing wheels are held between the side wall 66 and the web 146 of the central support member and are spaced from web 146 by a low friction washer 154 to allow the wheels to be turned freely during setting.

The date printing wheels in the set 150 and the portion of the shaft 130 which supports those wheels is provided with the ball-and-recess detent arrangement described with reference to FIG. 3, permitting the date printing wheels to be accurately aligned in a printing position.

The postage wheels have many of the features of the date wheels. Referring specifically to the postage setting wheel 164 and postage printing wheel 166 in the 10¢ bank, the setting wheel 164 includes a numeral-bearing rim 168 extending from one surface, peripheral notches 170 and peripheral gear teeth 172. The printing wheel includes a shoulder 174 having gears which mesh with the gears 172 on the setting wheel. The hub of the printing wheel 166 includes the described ball-and-recess detent arrangement while raised type heads for the numerals 0-9 are formed on the outer circumference of the print wheel.

As was discussed earlier, the position of each of the setting wheels in the postage printing bank is monitored by means of an adjacent encoder disc, such as encoder disc 176 for the 10¢ bank. The encoder discs are encoded with conductive material at selected areas. The wiper element ties any track having a conductive contact in line with a wiper element directly to a source of reference potential. The voltages in each of the tracks are read at the output terminals 180 for the encoder disc.

Figures 6, 7:
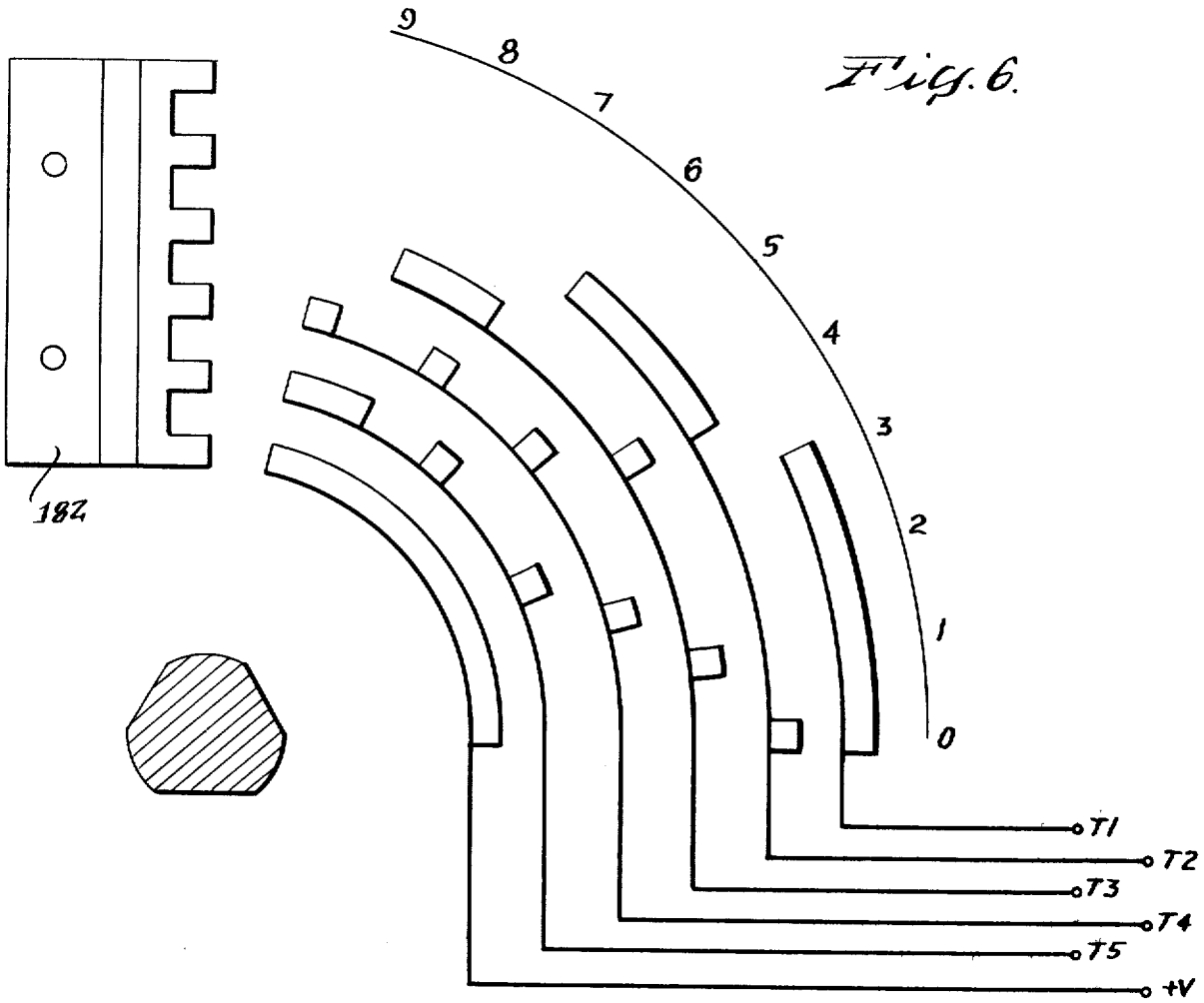
FIG. 6 is an enlarged view of a sector of an encoding disc illustrating a particular position-identifying coded pattern.
FIG. 7 is a table of binary representations of the coded pattern appearing on the disc shown in FIG. 6.

A preferred embodiment of encoder disc and its mode of operation are described in more detail with reference to FIGS. 6 and 7. FIG. 6 shows a sector of an encoder disc having a pattern of conductive contacts forming a two-of-five code. Such a code is a five bit code in which there are always two of five binary signals which have a certain value; for example, two binary ones and three binary zeroes. The encoder disc has five coding tracks T1-T5 and a reference track. The reference track is connected to a source of reference voltage. The pattern of the conductive contacts read across tracks T1-T5 identifies a particular sector location on the disc. For example, the "0" sector has conductive contacts in tracks T1 and T2 and the resulting five bit word 00011 identifies the "0" location sector. The angular position of the stationary encoder disc relative to the movable wiper element 182 is determined by reading the voltages at the output terminals in terminal set 184. The wiper element 182 will cause a reference voltage to exist at any track in which it is in contact with a conductive contact. For example, in the "6" sector the fingers of the wiper element will encounter contacts only in tracks T2 and T5, establishing the reference voltage level only on those two tracks.

The encoding/decoding table for the ten decimal values is shown in FIG. 7. Since the code which is used always has the same number of binary ones and binary zeroes regardless of the decimal value represented, an error check can be performed simply by adding the number of binary ones which are detected to make sure that only two are read. If more or fewer binary ones are detected, an error is indicated. An indicator lamp would be provided on the unit to notify the user of this condition.

Figure 8:
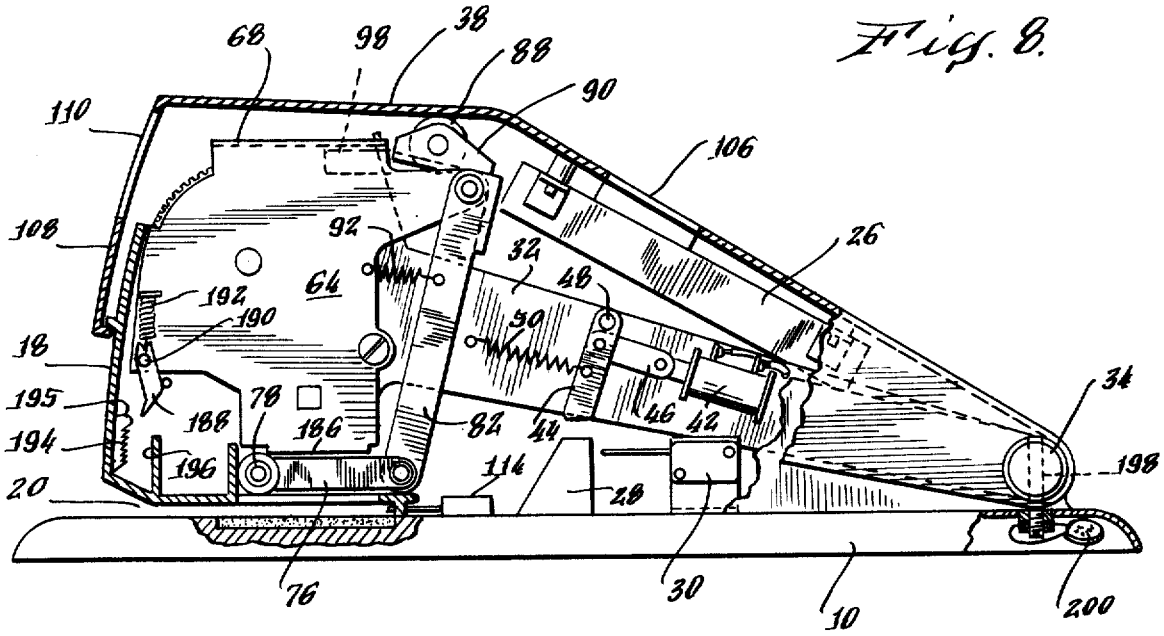
FIG. 8 is a side view of the applicator with the housing and side walls removed, showing the components in their initial or rest positions.
Figure 9:
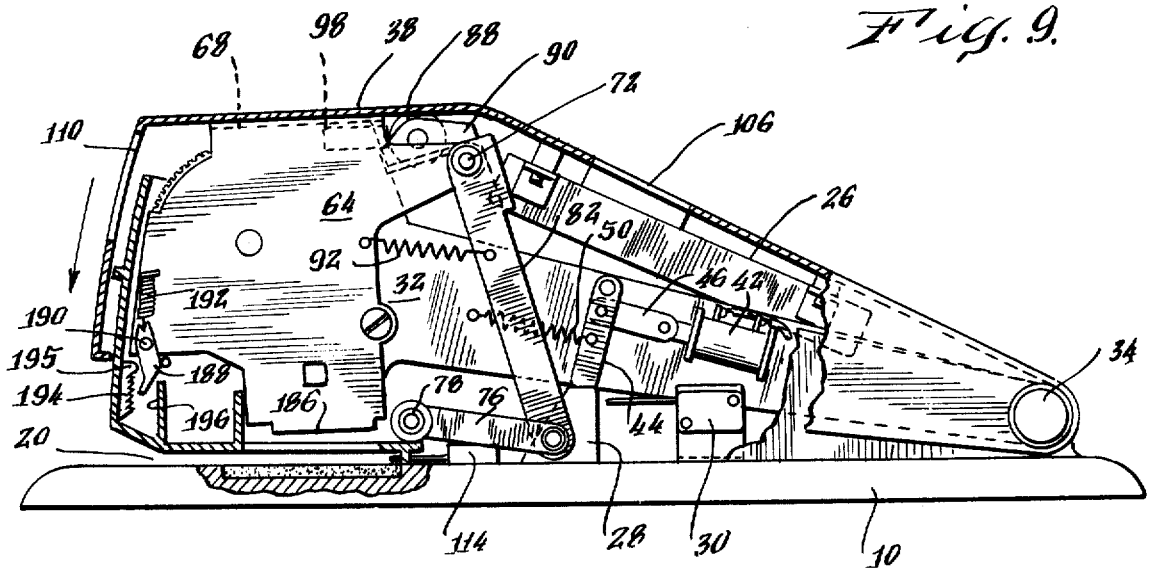
FIG. 9 is another side view showing the applicator with the housing depressed to a predetermined first position in the course of a postage-printing stroke.

The elements described above operate in a manner to be described with reference to FIGS. 8-11 to permit postage to be printed by a low cost but secure device. FIG. 8 is a side view of the device in its initial or rest position. The print system support member 32 is biased upward or away from the base plate 10 by the coil spring 100 described earlier, while the cover member 38 is biased away from the print system by coil spring 102. In the rest condition, the inking roller 74 supported by rollers 78 sits at the left edge of a printing face 186. A pawl 188 mounted on a pivot pin 190 is biased in a counterclockwise direction by a compressed spring 192. The pawl 188 cooperates with a ratchet 194 and camming surfaces 195 and 196 and in a manner and for a purpose which will be described with reference to subsequent Figures.

To apply postage using the illustrated device, the user first establishes the desired postage setting by manipulating the setting thumbwheels through the access opening 110. The cover member 38 is then depressed to a predetermined first position illustrated in FIG. 9. As the cover member is moving into this position, the pawl 188 is cammed to the left by the camming surface 196. As the cover member 38 moves, it forces wheel 88 downward, causing the rigidly-connected arm 82 to move to the right. The arm 82 draws the inking roller across the printing face 186 to deliver fresh ink to the type heads.

As the cover member 38 comes into contact with the bridge member 68 of the shield 62, the bridge member 68 and the print system are forced downward in a counterclockwise direction about the pivot point 34. As the print system support member 32 moves downward, release lever 44 may be brought to rest firmly against the upper surface of the detent block 28 to limit further movement of the print system and the cover member 38.

Cover member 38 also actuates the switch 98, causing that switch to generate an "inking complete" signal for use by the microcomputer module 26. Upon receipt of an "inking complete" signal, the microcomputer 26 reads and decodes the encoding disc associated with each of the postage printing wheels. The amount represented by the current setting of the thumbwheels is compared internally with the contents of the descending register to determine whether the applicator has enough postage to print the requested postage amount. If the postage balance remaining in the descending register is not great enough, the microcomputer 26 will energize an indicator to give the user notice of this fact. Under these conditions, the user will be unable to force the meter past the predetermined first position since the release lever 44 will be seated against the detent block 28.

Figure 10:
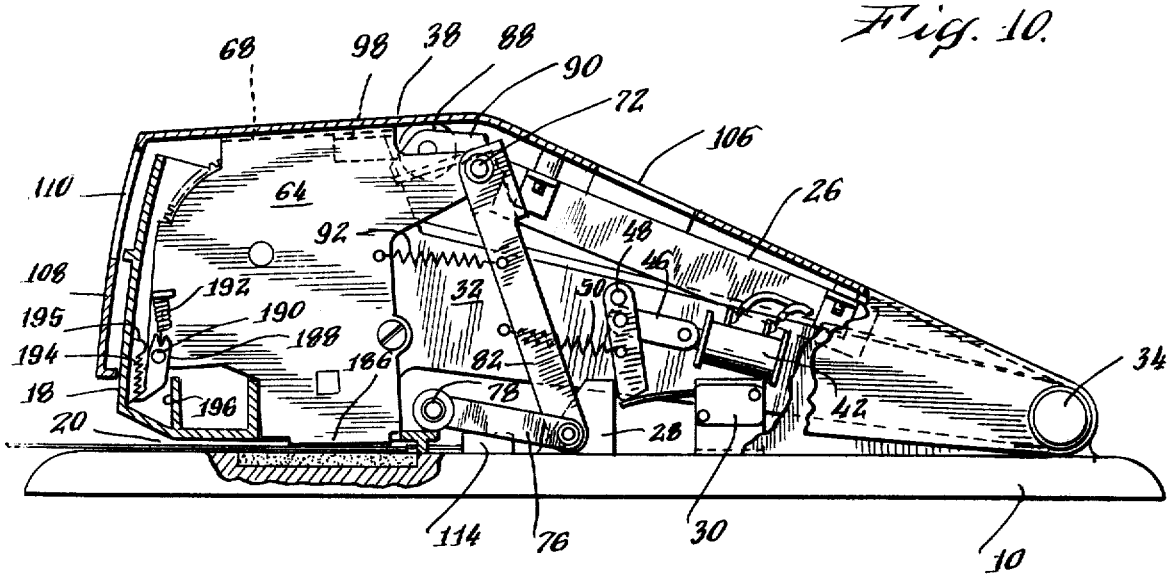
FIG. 10 is a side view showing the applicator with the housing fully depressed to a second, postage-printing position.
Figure 11:
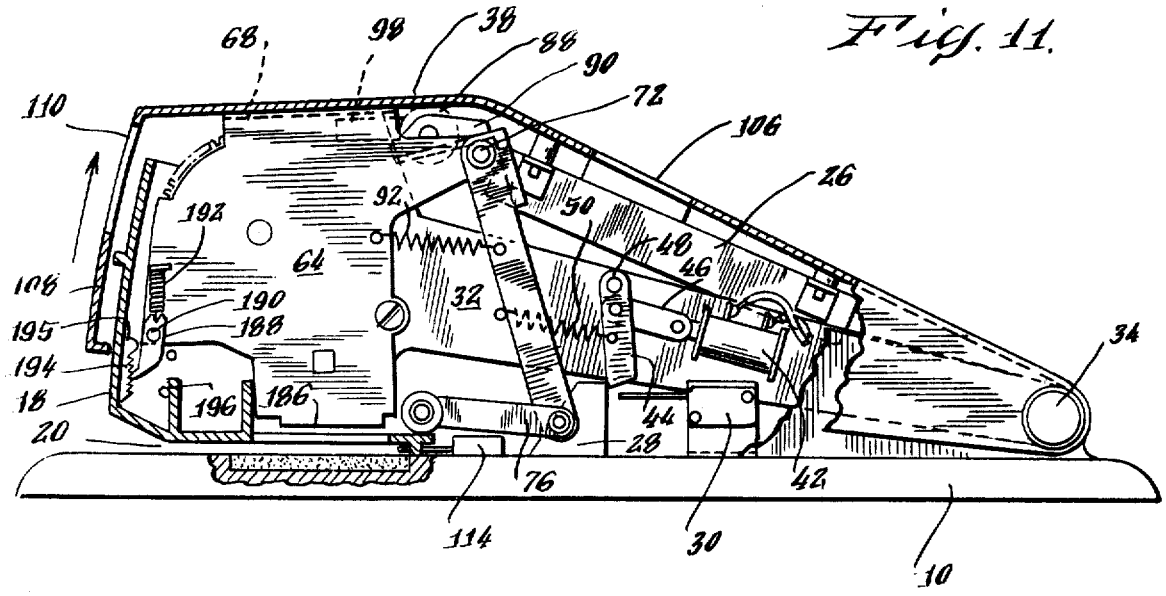
FIG. 11 is a side view showing the applicator on the return stroke from a postage-printing operation.

If, however, the comparison shows that the remaining postage is adequate to print the requested postage and if a letter is detected in the letter receiving slot 20 by means of the letter-in-place switch 114, the microcomputer 26 generates a control signal for solenoid 42, energizing that solenoid to draw the release lever 44 to the right against the force of return spring 50. When the release lever 44 clears the detent block 28, as shown in FIG. 10, continued downward pressure on cover member 38 forces the printing elements into the letter receiving slot 20 to print postage on the face of the letter in that slot.

The release lever 44 actuates the "postage count" switch 30, which provides a signal to the microcomputer 26 causing the microcomputer to update its postal accounting storage locations, specifically the ascending register and the descending register.

At the completion of the printing stroke, the pawl 188 will have been forced over center by camming surface 196, causing compressed spring 192 to bias the pawl 188 toward ratchet 194. The user must relieve the downward pressure on the housing 38 to permit the cover member 38 and the print system to begin moving upwardly under the forces of the coil springs 100 and 102. During this upward movement the tip of pawl 188 rides over the surface of the ratchet 194. The ratchet 194 will not impede upward movement of the meter components. If, however, an attempt is made to re-depress the meter housing, the pawl 188 will engage the ratchet 194 to prevent downward movement of the housing. The pawl is disengaged when its tip rides up on camming surface 195 which forces the pawl back over center to its original position.

As the cover member 38 moves upward, the pressure on roller 88 is relieved to allow coil spring 92 to draw the arm 82 of the inking roller mechanism to the left. This clockwise movement of the arm 82 moves the inking roller to the left across the print face 186 to the rest position shown in FIG. 8. The spring 50 exerts a clockwise force on the release lever 44. When the postage applicator is at or near its postage printing position, any clockwise movement of the release lever 44 due to this spring force is prevented by the detent block 28. When the lower end of the release lever 44 clears the detent block 28 on the upward or return stroke, the coil spring 50 draws the release lever in a clockwise direction to the extent permitted by the linkage 46. When the release lever 44 has been drawn into alignment with the top of detent block 28, no further postage can be printed until the solenoid 42 is again re-energized.

The unit operates on a highly secure manner. When the cover member 38 is first moved downward, the access opening 110 moves out of alignment with the thumbwheels to prevent any further setting changes. The printing wheel settings are not read until switch 98 indicates that the housing and the print system have been depressed to a position in which the thumbwheels are inaccessible from the exterior of the instrument.

The release lever 44 provides an effective physical interlock which prevents the applicator from being depressed beyond the predetermined first position unless the microcomputer 26 is provided with signals indicating that there is an adequate amount of postage and that there is a letter in place in the device. Once these conditions are met and the solenoid 42 is actuated to draw the release lever 44 away from the detent block 28, the release lever 44 actuates the "postage count" switch 30 to cause the meter to update the ascending and descending registers by the amount of the current setting of the printing wheels.

Because the base plate 10 of the instrument is solid, the microcomputer 26, the solenoid 42, the postage-count switch 30 and the "inking-complete" switch 98 are all inaccessible from outside the applicator. Access to these and most of the other components of the applicator requires that the meter be disassembled by removing a bolt 198 at the pivot point 34. The bolt 198 is provided with an opening which receives a United States Postal Service lead seal 200. The bolt can not be removed without destruction of this seal.

Figure 12:
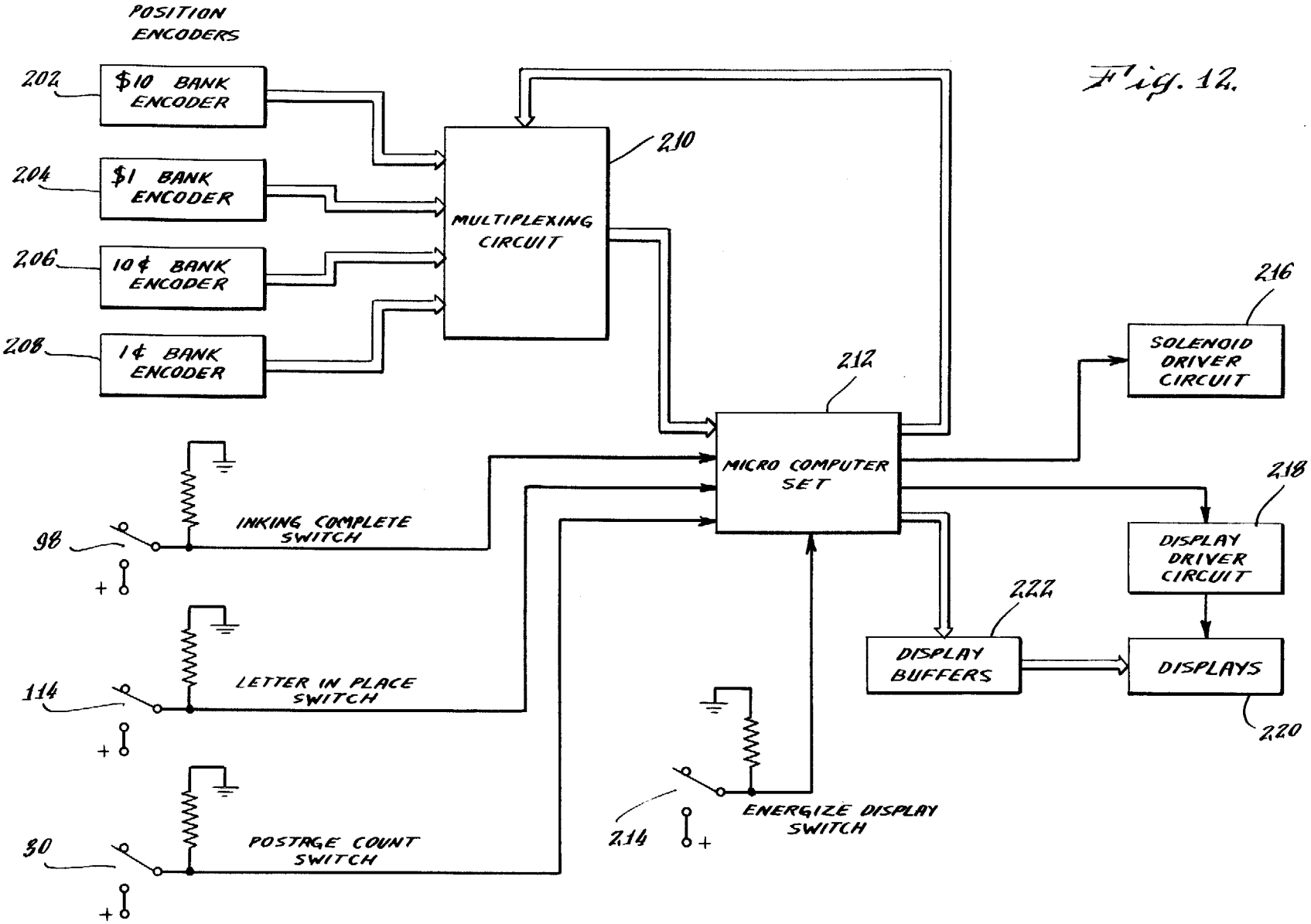
FIG. 12 is a schematic diagram of the electrical system of the applicator shown in FIGS. 1-11.

FIG. 12 is a block diagram of the electrical system of the postage applicator. The encoder disc for the $10, $1, $0.10 and $0.01 setting wheels are represented at 202, 204, 206 and 208, respectively. The five bit output from each of the encoders is applied to a multiplexing circuit 210 which operates under the control of a microcomputer set 212 to sequentially read each five bit output. After a cycle of four read operations, the microcomputer 212 is provided with a representation of the total postage setting.

The microcomputer 212 also has inputs from the inkingcomplete switch 98, the letter-in-place switch 114, the postagecount switch 30 and an energize display switch 214 which permits a user to obtain a display of the contents of the ascending and descending registers on command. The primary reason for including such a switch is to avoid the necessity of having the digital display energized at all times. A continuous display would be consume power, which is undesirable particularly where the microcomputer is to be powered by a re-chargable battery rather than an external voltage source.

Outputs from the microcomputer 212, which operates under the control of a program stored in a read only memory, are provided to a driver circuit 216 for the solenoid 42, to a display driver circuit 218 which provides display-initiating signals for the digital displays, the insufficient postage indicator, and a reading error indicator, all of which are indicated generally at 220.

The information to be displayed is stored in a set of display buffers 222 which make it possible for the needed information to be displayed upon command without the steps of retrieving the information from memory and writing it into the buffers each time.

Each of the components of the system described above may by itself be conventional. The microcomputer set 212 may be any one of a number of commercially available microprocessors such as the MCS 4040 microprocessor available from Intel Corporation or one of the Rockwell MM 76 family of 1-chip microcomputers available from Rockwell International Corporation.

Figure 13:
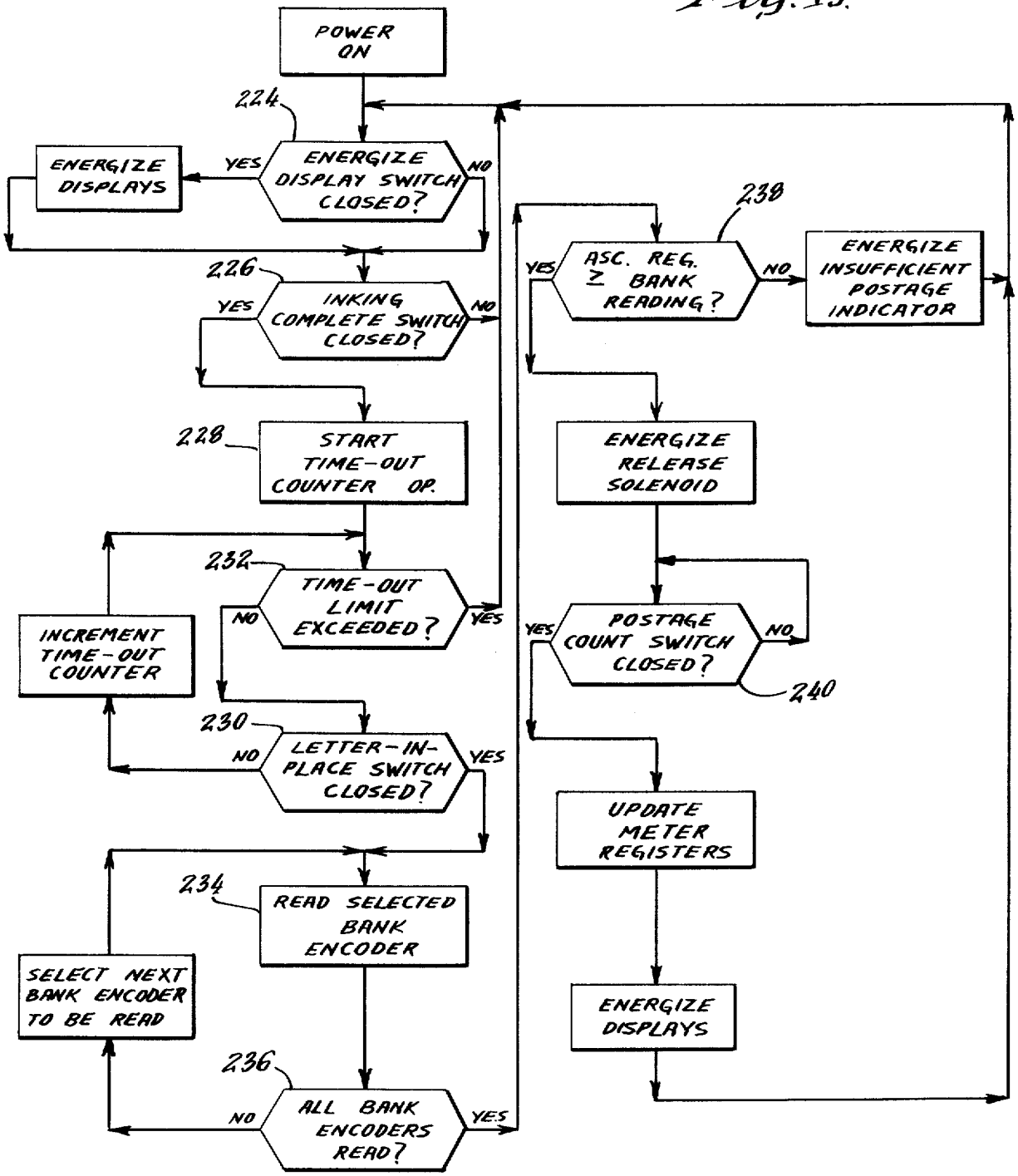
FIG. 13 is a flow chart of one program for the electrical system.

FIG. 13 is a simplified flow chart of the operation of the electrical system described above. A check 224 is made as to whether the energized display switch 214 is closed. This check can be made either by polling the switch periodically or by connecting the switch to an interrupt input terminal of the microcomputer to provide an interrupt signal which is basically the same as check 224. If the switch 214 is found to be closed, the microcomputer provides signals to the display driver circuit 218 which causes the current contents of the ascending and descending registers to be displayed on the digital display 106 of the applicator for a timed, limited period of time. Program control then continues to a second decision point 226. If the energized display switch is not closed, program control goes directly from point 224 to point 226 without any display of register contents.

A check is then made as to whether the inking-complete switch is closed. If it isn't, indicating that a user has not begun to depress the housing 38, program control returns to the starting point. If closure of the inking-complete switch is detected, a timeout counter within the microcomputer is set at 228 and a check 230 made as to whether the letter-in-place switch has been closed. If a switch closure is not detected, the time-out counter is incremented before the check 230 is repeated. The program will repeat this loop until the check 230 indicates that a letter has been placed into position or a maximum time interval has been exceeded as determined by a check 232. If a maximum time elapses with no letter being detected, the check 232 returns to program control to the start of the program. This prevents the meter from cycling continuously if a user accidentally depresses the cover or if he changes his mind about printing postage after he has depressed the housing but before he has inserted the letter.

If the letter is inserted into the slot 20 within the allowable period of time, the microcomputer selects and reads one of the print wheel encoders in operation 234. A check 236 is made as to whether all of the printing wheels have been read. If not all have been read, the next printing wheel is selected and read. This loop is repeated until all of the printing wheels have been read, at which time the microcomputer makes a decision 238 as to whether the contents of the descending register are greater than or equal to the detected setting of the printing wheels.

If the comparison indicates the descending register balance is less than the setting of the postage applicator, the microcomputer causes the insufficient postage indicator to be energized to signal the user. Program control is then returned to the starting point. A mechanical interlock is not thought to be necessary at this point for two reasons. First, while the stored postage might be insufficient to print the particular postage amount selected in the current operation, there may be adequate postage to print some lesser amount. Returning program control to its starting point makes the entire amount of postage available to the user. Second, the applicator can not be released to a postage-printing position at this point in the operating cycle, making a mechanical interlock unnecessary.

If the decision 238 shows that the descending register contains adequate postage to print the detected amount, the microcomputer energizes the release solenoid to draw the release lever away from the detent block. A decision 240 is made as to whether the postage-count switch is closed. Until a switch closure is detected, this check is repeated in a continuous loop. It would be possible to include a timeout circuit of the type described above. Such a circuit is probably not necessary since all of the conditions for a proper postage printing operation, such as adequate postage and a letter in place, must be satisfied before this portion of the program is executed. Once the postage-count switch closure is detected, indicating that the postage applicator has entered its printing position, the ascending and descending registers of the meter are updated by the amount of printed postage. To give the user an indication of the new balances in each of these registers, the digital displays may then be energized for a limited period of time before program control is returned to the start of the program.

Figure 14:
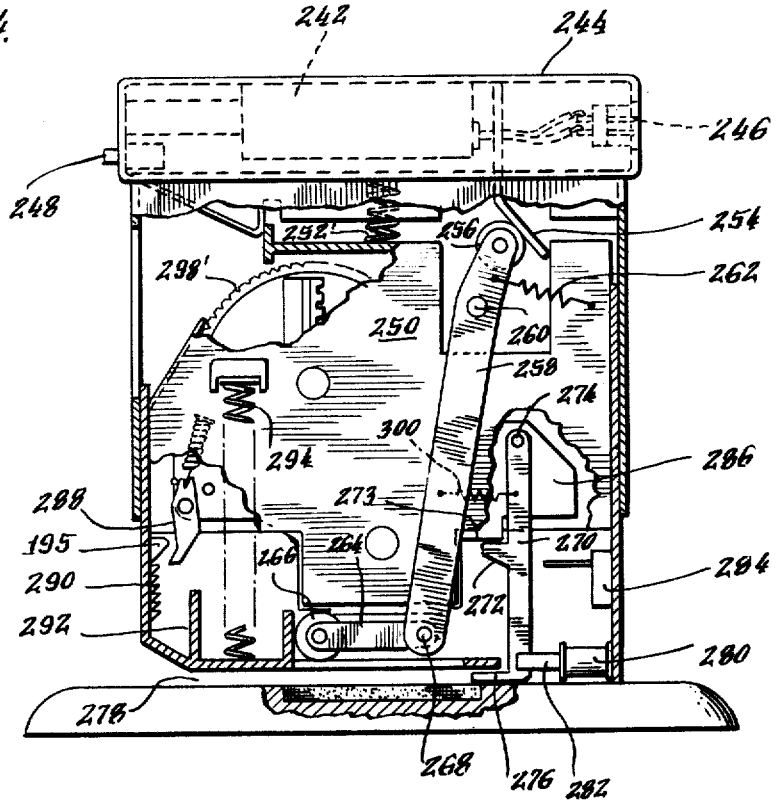
FIG. 14 is a side view of an alternate embodiment of a postage applicator in its initial or rest position.
Figure 15:
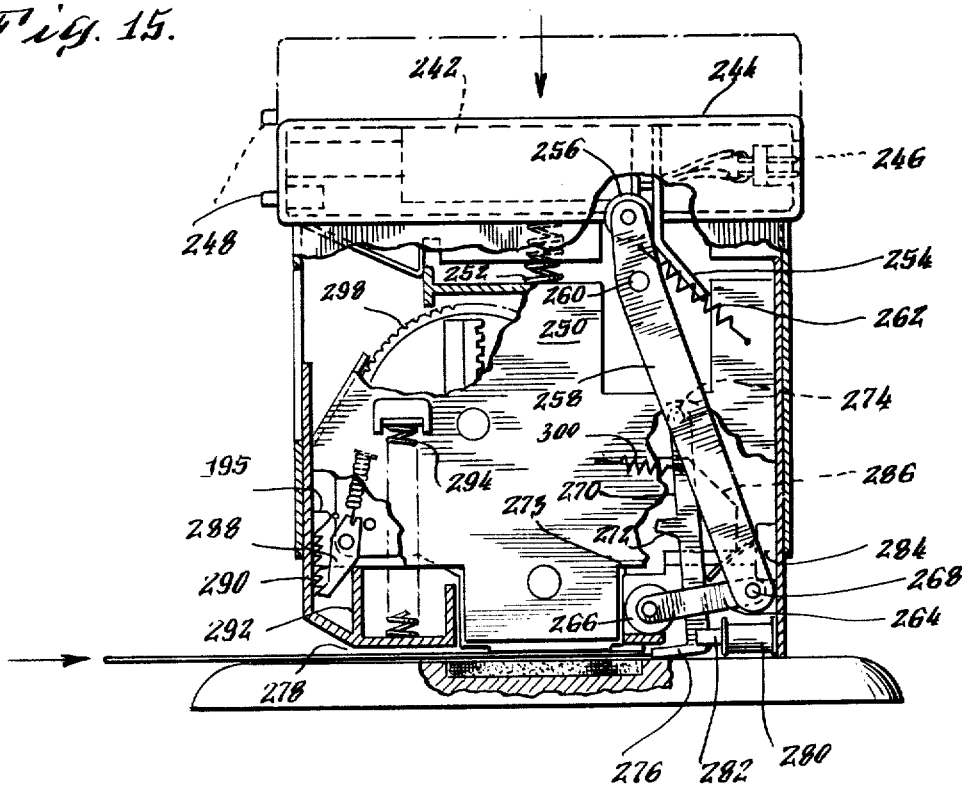
FIG. 15 is a side view of the applicator of FIG. 14 in its postage-printing position.

An alternate embodiment of the invention is disclosed in FIGS. 14 and 15. In this embodiment, a microcomputer 242 is incorporated into a top piece 244 which also carries the meter recharging contacts 246 and an on-off switch 248. The top piece 244 is resiliently supported above a print system frame 250 by one or more interposed coil springs, such as coil spring 252. A camming surface 254 extends downwardly from the top piece 244 into engagement with a roller 256 at the upper end of an inking roller mechanism including an arm 258 which pivots about a pivot point 260 on the print system frame 250. A return spring 262 is connected between the print system frame 250 and a point on the arm 258 above the pivot point to provide a clockwise return force. The lower end of arm 258 is connected to the inking roller 266 through a link 264 from roller 266 to an intermediate pivot point 268.

The device further includes a letter-in-place mechanical interlock consisting of a pivot arm 270 having a small abutment 272 midway between a pivot point 274 and a blade 276 extending into a letter-receiving slot 278 at the base of the machine. The abutment is normally in the path of a shoulder 273 on the print system frame 250.

The device further includes a solenoid 280 having an armature mechanically coupled to the arm 270 through a linkage 282. A postage-count switch 284 is secured to a side wall of the meter directly above the solenoid 280 and in the downward path of an abutment 286 on the print system frame 250. A ratchet 288, a pawl 290 and a camming surface 292 are provided at the left or front of the device. The print system frame 250 is resiliently supported above the base plate by means of a coil spring 294.

The components of this embodiment of the invention are shown in their rest positions in FIG. 14. In using this device, a user must insert a letter 296 into the letter receiving slot to force the arm 270 in a counterclockwise direction about pivot point 274. This counterclockwise movement of the arm 270 partially withdraws the abutment 272 from beneath the shoulder 273 of the print system frame 250. As the top piece 244 moves downward, roller 256 rides on the camming surface 254 to cause the inking roller lever 258 to pivot in a counterclockwise direction about pivot point 260. Inking roller 266 is drawn across the face of the printing wheels previously selected by means of thumbwheels 298. An inking-complete switch (not shown) could be located in the path of the lever 258 to provide a signal indicating that the top piece of the postage applicator has been moved downward into a first predetermined position in which reading of the printing wheel settings would be initiated by the microcomputer 242. If the reading shows that an adequate amount of postage remains in the descending register, solenoid 280 is energized to withdraw the lever 270 further to the right. When the lever 270 is withdrawn to the maximum extent, abutment 272 will clear shoulder 273 allowing the print head frame 250 to be pressed past the first predetermined position and into a postage-printing postion to provide the signals needed to update the ascending and descending registers within the microcomputer 242.

When the user releases the top piece of the postage applicator, the coil springs 294 and 252 bias the print system frame 250 and the top piece 244 upwardly and away from one another. Coil spring 262 provides a clockwise restoring force for the inking roller mechanism while coil spring 300 connected between the print system frame 250 and the letter-in-place lever 270 provides a clockwise force which draws the blade 276 back into the letter receiving slot 278. When the lever 270 moves in a counterclockwise direction, the abutment 272 is moved back into position beneath the shoulder 273 to mechanically lock the meter out of the postage printing position.

The pawl 288, the ratchet 290 and the camming surface 292 function in exactly the same way as in the first-described embodiment of the invention to prevent re-depression of the top piece 244 once the postage applicator has begun its return from the postage printing position.

Figure 16:
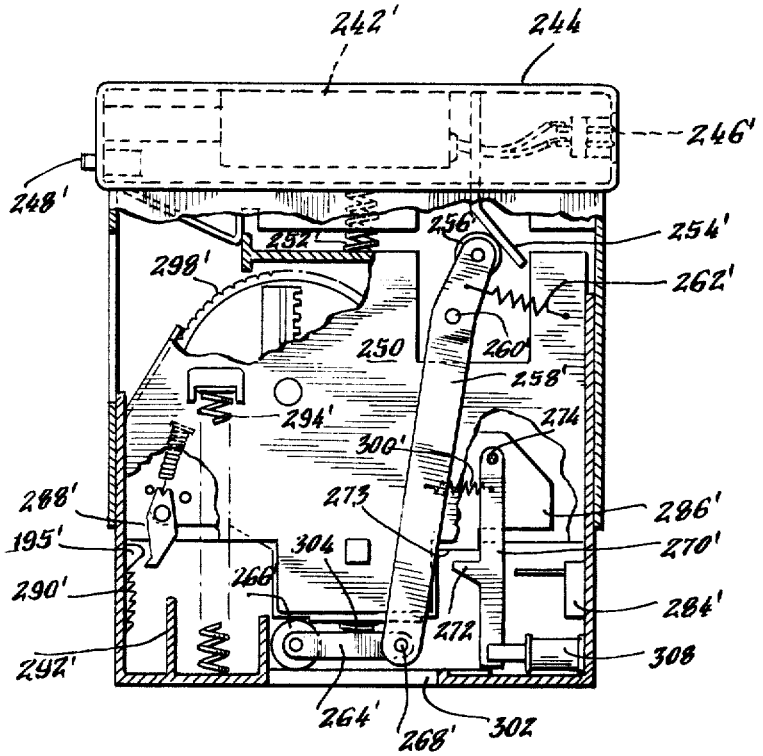
FIG. 16 is a side view of a package postage applicator in its initial or rest position.
Figure 17:
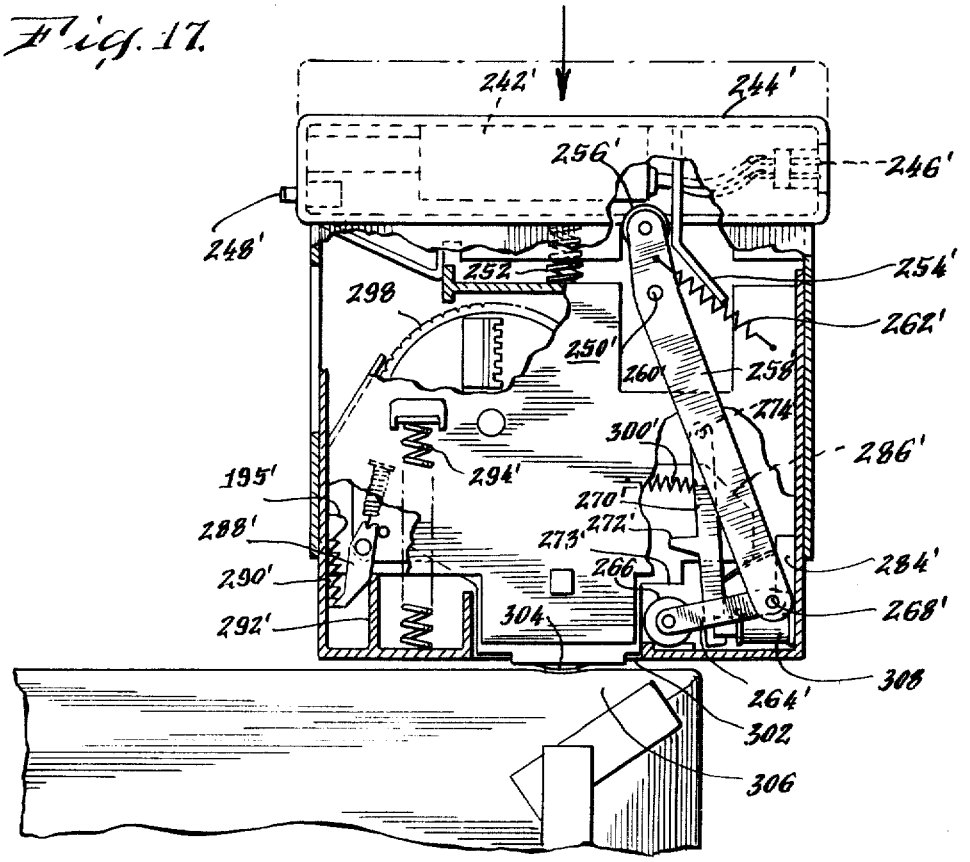
FIG. 17 is a side view of the applicator of FIG. 16 in its postage-printing position.

FIGS. 16 and 17 illustrate an embodiment of the invention which may be used to apply postage to packages or envelopes too bulky to be placed in a letter receiving slot. This embodiment is very similar to the embodiment just described.

Those components which are identical to components in the previously-described embodiment are indicated by adding a prime (') to the identifying numeral. For example, part number 288' identifies a pawl in FIGS. 16 and 17 which is identical in design and function to the pawl 288 in FIGS. 14 and 15.

The primary difference is that there is no base plate at the bottom of the instrument. There is, instead, an opening 302 through which the print wheels 304 may extend slightly to provide a postage imprint on a package 306. Rather than a blade-type letter sensing switch extending into a slot, a small contact switch would be utilized with the contact extending just below the bottom surface of the postage applicator to provide a signal indicating that the applicator is resting against a package or at least on a print-receiving surface. When this signal is received by the microcomputer and it is determined that an adequate amount of postage exists in the meter, the release solenoid 308 is energized to allow the applicator to be depressed into a postage printing position.

To prevent an unscrupulous user from holding the applicator in a printing position while moving the applicator from one package to another, the microcomputer could be programmed to repeatedly update the ascending and descending registers by the amount of postage to which the meter is set at intervals on the order of one second until the meter is released from the printing position. The time interval selected has to be long enough for an honest user to have released the meter from its printing position but not so long that an unscrupulous user will have time to switch packages upon which postage is being printed.

While there have been described what are considered to be preferred embodiments of the invention, variations and modifications therein will occur to those skilled in the art once they are made aware of the basic concepts of the invention. Therefore, it is intended that the appended claims shall be construed to include all such variations and modifications as fall within the true spirit and scope of the invention.

What is claimed is:

1. A postage applicator including:

a first member which must be depressed by a user to initiate a postage-printing cycle;

a plurality of postage symbol printing elements, such of said elements being independently settable;

manually-actuated means for setting each of said printing elements;

encoding means for providing electrical signals representative of the current status of each of said printing elements;

switch means responsive to movement of said first member to a predetermined first position to generate a read-enabling signal;

detent means for inhibiting movement of said first member beyond the predetermined first position;

an electronic means connected to said encoding means, said switch means and said detent means to release said detent means under predetermined conditions to enable said first member to be moved beyond the predetermined first position into a postage-printing second position, said electronic means containing storage locations for postal accounting data.

2. A postage applicator as recited in claim 1 further including a second switch means reponsive to movement of said first member into the postage-printing second position for enabling said electronic means to update stored postal accounting data in accordance with signals generated by said encoding means.

3. A postage applicator as recited in claim 2 further including a pressure-actuated switch responsive to the presence of a mailable item at a predetermined position in said postage meter, and means connecting the output of said pressure-actuated switch to said electronic means.

4. A postage applicator as recited in claim 3 wherein said electronic means includes a microcomputer which operates under the control of a stored program, which program causes a detent-releasing signal to be generated only if the postage stored in the electronic storage locations is at least equal to the postage represented by the current setting of said printing elements and if said pressure-actuated switch indicates a mailable item is at said predetermined positioned in said postage applicator.

5. A postage applicator as recited in claim 1 wherein said encoding means comprises a plurality of discs, each of which is associated with one of said postage symbol printing elements and each of which has circumferentially spaced indicia representing the angular position of the disc relative to a reference position.

6. A postage applicator as recited in claim 1 wherein said manually-actuated means comprises a plurality of thumbwheels having circumferentially-spaced coded indicia on the surface thereof, each of said thumbwheels being mechanically coupled to one of said printing elements so as to rotate said printing element upon rotational movement of said thumbwheel.

7. A postage applicator as recited in claim 6 wherein said first member comprises a cover member having an access opening which permits a user to set the thumbwheels prior to the start of a postage printing cycle, said housing being movable to misalign the access opening relative to the thumbwheels, thereby denying the user further access to the thumbwheels when the housing has been depressed to the predetermined first position.

8. A postage applicator as recited in claim 5 further including a plurality of signal-establishing means, each of said signal-establishing means being associated with and moveable relative to one of said discs.

9. A postage applicator as recited in claim 8 wherein each of said encoding discs includes a plurality of radially-spaced tracks of indicia, each of said tracks having circumferentially spaced positions which contain either indicia representing one binary value or no indicia representing the other binary value.

10. A postage applicator as recited in claim 9 wherein each indicia in a particular track is connected electrically to other indicia in the same track, each of said tracks having an output electrical connection.

11. A postage applicator as recited in claim 10 wherein each encoding disc further includes a track maintained at a reference potential and said signal-establishing means includes a conducting member for establishing an electrical connection between said reference track and any track having an indicia aligned with said conducting member, whereby the presence of an indicia aligned with said conducting member is indicated by the existence of a reference potential at the output electrical connection of the track.

12. A postage applicator as recited in claim 4 wherein said manually-actuated means comprises a plurality of thumbwheels having circumferentially-spaced coded indicia on the surface thereof, and each of said printing elements comprises a printing wheel, each of said thumbwheels being mechanically coupled to one of said printing wheels so as to rotate said printing wheel upon rotational movement of said thumbwheel.

13. A postage applicator as recited in claim 12 wherein said first member comprises a housing which overlies said thumbwheels while having an access opening which permits a user to set the thumbwheels prior to the start of a postage printing cycle, said housing being movable to misalign the access opening relative to the thumbwheels, thereby denying the user further access to the thumbwheels when the housing has been depressed to the predetermined first position.

14. A postage applicator as recited in claim 13 further including a plurality of signal-establishing means, each of said signal-establishing means being associated with and movable relative to one of said thumbwheels.

15. A postage applicator as recited in claim 14 wherein each of said signal establishing means includes a plurality of radially-spaced tracks of indicia on an encoding disc, each of said tracks having circumferentially spaced positions which contain either indicia representing one binary value or no indicia representing the other binary value.

16. A postage applicator as recited in claim 15 wherein each indicia in a particular track is connected electrically to other indicia in the same track, each of said tracks having an output electrical connection.

17. A postage applicator as recited in claim 16 wherein each encoding disc further includes a track maintained at a reference potential and said signal-establishing means includes a conducting member for establishing an electrical connection between said reference track and any track having an indicia aligned with said conducting member, whereby the presence of an indicia aligned with said conducting member is indicated by the existence of a reference potential at the output electrical connection of the track.

18. A postage applicator as recited in claim 7 further including a ratchet and pawl means movable with said printing elements said pawl engaging said ratchet when the housing begins to return from the postage-printing second position to prevent the housing from being prematurely re-depressed to the second position.

19. In an electronic postal meter having an electronic control circuit including an accounting register, a printing device having settable printing means controllable to effect the printing of postage on a surface, means for setting said printing means, and coding means for producing coded signals corresponding to the setting of said setting means; means for applying said coded signals to said electronic control circuit, and printing actuator means responsive to said control circuit for controlling said printing device to execute a printing cycle; the improvement wherein said coding means are continuously mechanically coupled to said printing device for continuously producing said coded signals and applying them to said electronic control circuit, and further comprising means for adjusting said accounting register with said coded signals substantially simultaneously with said printing of postage on said surface.

20. The postal meter of claim 19 wherein said printing device is substantially linearly movable with said actuator means during at least part of a printing cycle, for moving said printing means into and out of an engagement with said surface.

21. The postal meter of claim 20 wherein said actuator means is mounted to be movable independently of said printing device during a first part of a printing cycle, and further comprising means coupled to said electronic control circuit for interrupting movement of said printing device in the absence of determined operating conditions.

22. The postal meter of claim 21 further comprising inking means mounted to be movable by said actuator means during said first part of a printing cycle to ink said printing means, and switch means positioned to provide an output signal following the inking of said printing means, said output signal being applied to said electronic control circuit.

23. The postal meter of claim 22 wherein said electronic control circuit comprises means responsive to said output signal for enabling said movement of said printing device with said actuator means.

24. In an electronic postal meter having an electronic control circuit including an accounting register, a printing device having settable printing means controllable to effect the printing of postage on a surface, means for setting said printing means, and coding means for producing coded signals corresponding to the setting of said setting means; means for applying said coded signals to said electronic control circuit and printing actuator means responsive to said control circuit for controlling said printing means to execute a printing cycle; the improvement wherein said actuating means is movable separably from said printing means through a first part of a printing cycle, and is mounted to engage said printing means for movement therewith in a second part of a printing cycle, and further comprising means coupled to said control means for inhibiting said second part of a printing cycle in the absence of determined operating conditions.

25. The postal meter of claim 24 wherein said printing device is movable in a substantially linear direction by said printing actuator means.

26. The postal meter of claim 24 wherein said inhibiting means comprises lever means positioned to engage an abutment to inhibit movement of said actuating means, and solenoid means coupled to said electronic control circuit for disengaging said lever means from said abutment.

27. The postal meter of claim 26 further comprising switch means engageable by said lever means during said second part of said printing cycle, said switch means being positioned to apply a signal to said electronic control circuit substantially simultaneously with the termination of said second part of a printing cycle to enable said electronic control circuit to adjust said register in accordance with said coded signals.

28. A postal meter having a secure housing with a printing window, a printing device having printing means mounted for substantially linear movement within said housing whereby during a terminal part of a printing cycle said printing means projects into said window for printing postage on a surface aligned therewith, coding switch means adjustable from the outside of said housing and mechanically positively coupled to said printing device for setting said printing means and continuously producing coded signals corresponding to the setting of said printing means, an electronic control circuit connected to receive said coded signals and including an electronic accounting register, actuator means mounted to be movable into an out of engagement with said printing device, whereby said actuator means engages said printing device during said terminal part of said printing cycle for moving said printing device during said terminal part of said printing cycle, and means in said housing and coupled to said electronic control circuit for inhibiting movement of said printing device with said actuator means in the absence of determined conditions.

29. The postal meter of claim 28 wherein said actuator means comprises a movable cover member on said housing, and further comprising inking means within said housing mounted to be operable by said cover during an initial part of a printing cycle, switch means operable by said inking means at the termination of said initial portion of said cycle, and means coupling said last mentioned switch means to said electronic control circuit, whereby said terminal part of said printing cycle may be inhibited by said inhibiting means in the absence of operation of said last mentioned switch means.

30. The postal meter of claim 29 comprising pivotal mounting means for pivotally mounting said printing device and cover to said housing at a common axis, said pivotal mounting means constituting the sole mounting means for said cover.

* * * * *

UNITED STATES PATENT AND TRADEMARK OFFICE

CERTIFICATE OF CORRECTION

PATENT NO. : 4,246,643

DATED : January 20, 1981

INVENTOR(S) : David W. Hubbard

It is certified that error appears in the above-identified patent and that said Letters Patent are hereby corrected as shown below:

Column 5, line 60, change "mouth-indicating" to -- month-indicating --

Column 5, line 64, change "mouth printing" to -- month-printing --

Column 9, line 18, change "re-chargable" to -- rechargeable --

Column 16, line 22, change "an" to -- and --

Signed and Sealed this

*Thirty-first* Day of *August 1982*

[SEAL]

*Attest:*

GERALD J. MOSSINGHOFF

*Attesting Officer*

*Commissioner of Patents and Trademarks*